US010551766B1

(12) United States Patent
Nakachi et al.

(10) Patent No.: US 10,551,766 B1
(45) Date of Patent: Feb. 4, 2020

(54) IMAGE FORMING APPARATUS

(71) Applicant: KYOCERA Document Solutions Inc., Osaka (JP)

(72) Inventors: Kazuhiro Nakachi, Osaka (JP); Satoshi Sunayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/510,255

(22) Filed: Jul. 12, 2019

(30) Foreign Application Priority Data

Jul. 17, 2018 (JP) ..... 2018-133989

(51) Int. Cl.
*G03G 15/08* (2006.01)
*G03G 15/00* (2006.01)

(52) U.S. Cl.
CPC ..... *G03G 15/0851* (2013.01); *G03G 15/0868* (2013.01); *G03G 15/5041* (2013.01); *G03G 2215/00037* (2013.01); *G03G 2215/025* (2013.01)

(58) Field of Classification Search
CPC ..... G03G 15/0851; G03G 15/5041; G03G 15/5058; G03G 2215/00037
See application file for complete search history.

(56) References Cited

U.S. PATENT DOCUMENTS

2003/0219266 A1* 11/2003 Itagaki ..... G03G 15/5037 399/38
2014/0255052 A1* 9/2014 Fujiwara ..... G03G 15/5058 399/49

FOREIGN PATENT DOCUMENTS

JP 2005-189790 A 7/2005

* cited by examiner

*Primary Examiner* — Sandra Brase
(74) *Attorney, Agent, or Firm* — Studebaker & Brackett PC

(57) ABSTRACT

A mode control section forms a plurality of reference toner images having different densities on a photosensitive drum, where the frequency of an alternating-current voltage of a development bias is varied with a potential difference between direct-current voltages of a development roller and the photosensitive drum maintained constant, generates a reference straight line indicating a relationship between a toner amount of each reference toner image obtained by converting the density of the measured reference toner image into weight, and a representative value of current values of a development current measured during formation of the reference toner image, and acquires the amount of electrostatic charge of toner using the reference straight line.

5 Claims, 8 Drawing Sheets

IMAGE FORMING APPARATUS

INCORPORATION BY REFERENCE

The present application claims priority under 35 U.S.C. § 119 to Japanese Patent Application No. 2018-133989, filed Jul. 17, 2018. The contents of this application are incorporated herein by reference in their entirety.

BACKGROUND

The present disclosure relates to image forming apparatuses to which the two-component development technique is applied.

A conventionally known image forming apparatus for forming an image on a sheet is provided with a photosensitive drum (image bearing member), a developing device, and a transfer member. In such an image forming apparatus, an electrostatic latent image formed on the photosensitive drum is transformed into a visible image by the developing device, so that a toner image is formed on the photosensitive drum. Thereafter, the toner image is transferred to a sheet by the transfer member. As a development technique of transforming an electrostatic latent image to a visible image, i.e. a toner image, the two-component development technique of using a developer containing toner and carrier is known.

In the two-component development, observed is the phenomenon that the developer degrades due to influences such as the number of printed copies, environmental variations, the printing mode (the number of successively printed copies per job), and the page coverage, so that the amount of electrostatic charge of toner is altered. This leads to problems such as a reduction in image density, the occurrence of toner fog, and the scattering of toner. In order to address such problems, some techniques have conventionally been employed in which a change in the amount of electrostatic charge of toner is predicted from the number of printed copies, environmental variations, the printing mode, the page coverage, etc., and the toner density, the development bias, the surface potential of the photoreceptor, the rotational speed of the development roller, the output of the suction fan for collecting scattered toner, etc., are adjusted so as to reduce or inhibit the reduction of image density, the exacerbation of toner fog, and the exacerbation of toner scattering.

However, these techniques are only based on the combination of predictions under respective conditions, i.e. the number of printed copies, environmental variations, the printing mode, and the page coverage. Therefore, if these conditions are changed together, it is difficult to accurately predict the amount of electrostatic charge of toner.

Therefore, some techniques of accurately predicting the amount of electrostatic charge of toner have conventionally been proposed. For example, while a development bias is being applied to the development roller bearing the developer, the current value of a current (hereinafter referred to as a "development current") flowing between the photosensitive drum and the development roller is measured. It is assumed that the measured current value of the development current is equal to the amount of electric charge of toner moved from the development roller to the photosensitive drum. The amount of the toner is calculated from the result of measurement of the density of a developed toner image. The amount of electrostatic charge on the toner is calculated from the amount of electric charge of the toner and the amount of the toner.

SUMMARY

An image forming apparatus according to an aspect of the present disclosure includes: an image bearing member configured to rotate, having a surface on which an electrostatic latent image is formed, and configured to bear a toner image obtained by transforming the electrostatic latent image into a visible image; an exposure device configured to form the electrostatic latent image on the surface of the image bearing member; a development roller disposed facing the image bearing member, and configured to rotate, bear a developer containing toner and carrier on a peripheral surface thereof, and supply the toner to the image bearing member and thereby form the toner image; a development bias applying section configured to apply a development bias including a combination of a direct-current voltage and an alternating-current voltage to the development roller; a density measuring section configured to measure a density of the toner image; a current measuring section configured to measure a current value of a development current flowing between the image bearing member and the development roller; and an amount-of-electrostatic charge acquiring section. The amount-of-electrostatic charge acquiring section executes a reference toner image developing operation of controlling the exposure device and the development bias applying section to form a plurality of reference toner images having different densities on the image bearing member, where the frequency of the alternating-current voltage of the development bias is varied with a potential difference between direct-current voltages of the development roller and the image bearing member maintained constant, a reference straight line generating operation of generating a reference straight line indicating a relationship between a toner amount of each reference toner image obtained by converting the density of the reference toner image measured by the density measuring section into weight, and a representative value of current values of the development current measured by the current measuring section during formation of the reference toner image, and an amount-of-electrostatic charge acquiring operation of acquiring the amount of electrostatic charge of the toner using the reference straight line.

DETAILED DESCRIPTION

Embodiments

An image forming apparatus 10 according to an embodiment of the present disclosure will now be described in detail with reference to the accompanying drawings. In this embodiment, as an example image forming apparatus, a tandem color printer is described. The image forming apparatus may, for example, be a photocopier, a fax machine, or a multifunction peripheral including these functions. The image forming apparatus may form a single-color (monochromatic) image.

Figure 1:
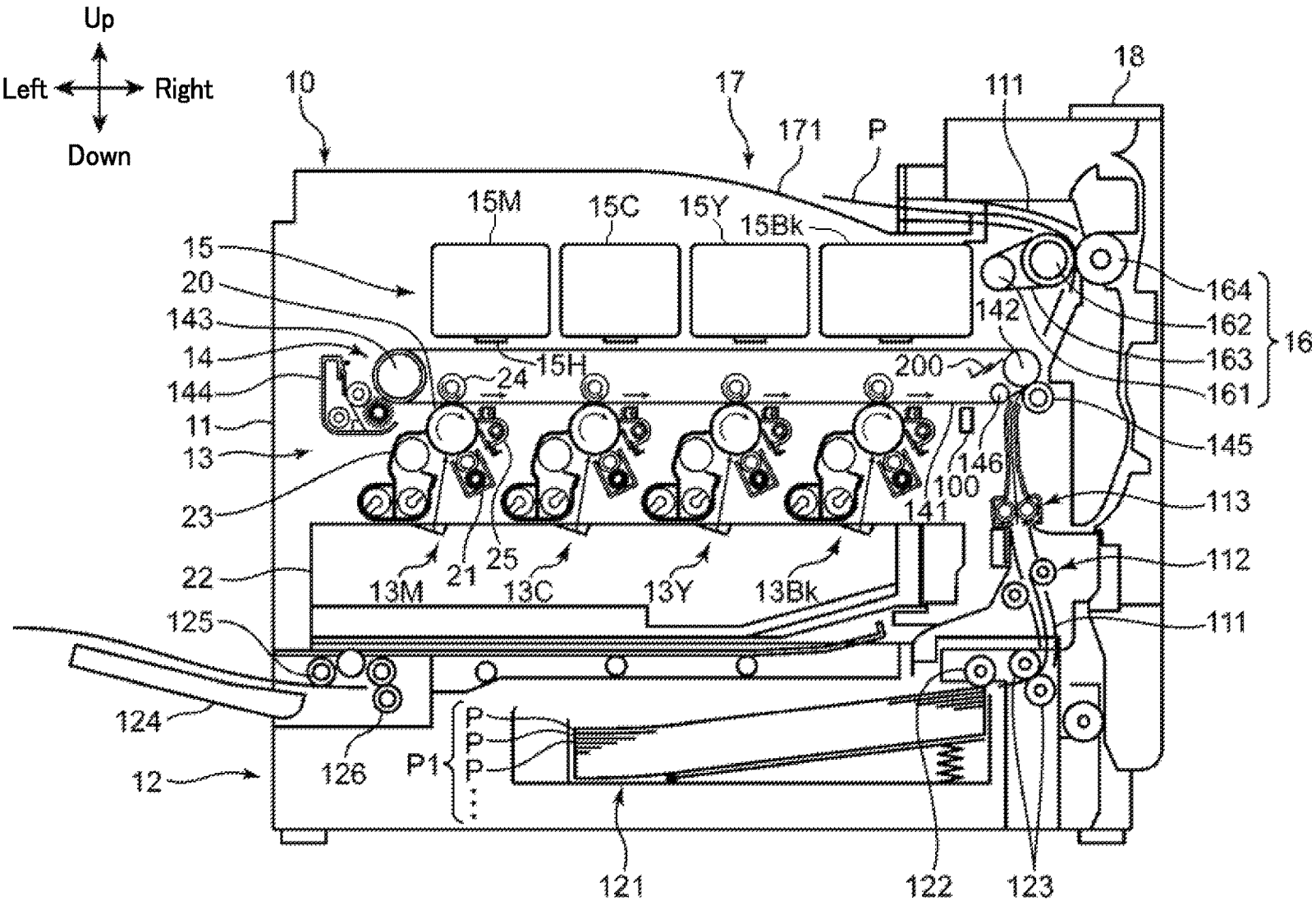
FIG. 1 is a cross-sectional view showing an internal structure of an image forming apparatus.

FIG. 1 is a cross-sectional view showing an internal structure of the image forming apparatus 10. The image forming apparatus 10 is provided with an apparatus body 11 including a box-shaped housing structure. In the apparatus body 11, provided are a paper feed section 12 for feeding a sheet P, an image forming section 13 for forming a toner image that is to be transferred to the sheet P fed from the paper feed section 12, an intermediate transfer unit 14 onto which the toner image is primarily transferred, a toner replenishing section 15 for replenishing the image forming section 13 with toner, and a fusing section 16 for fusion, to the sheet P, an unfused toner image formed on the sheet P. Furthermore, an exit section 17 to which the sheet P subjected to the fusing process in the fusing section 16 is ejected is provided at a top portion of the apparatus body 11.

An operation panel 18 for performing an operation of inputting an output condition, etc., for the sheet P is provided at an appropriate portion of the top surface of the apparatus body 11. The operation panel 18 includes a power key, a touch panel for inputting an output condition, and various operation keys.

In the apparatus body 11, a sheet conveyance path 111 extending vertically is also provided to the right of the image forming section 13. On the sheet conveyance path 111, a conveyance roller pair 112 for conveying a sheet to an appropriate portion is provided. A registration roller pair 113 for correcting skew of a sheet and sending a sheet to a nip part for secondary transfer described below with predetermined timing, is also provided upstream of the nip part on the sheet conveyance path 111. The sheet conveyance path 111 is for conveying the sheet P from the paper feed section 12 to the exit section 17 through the image forming section 13 and the fusing section 16.

The paper feed section 12 includes a paper feed tray 121, a pickup roller 122, and a paper feed roller pair 123. The paper feed tray 121 is removably attached to a lower portion of the apparatus body 11, and retains a sheet stack P1 that is a stack of sheets P. The pickup roller 122 pulls out the top sheet P of the sheet stack P1 retained in the paper feed tray 121 one sheet at a time. The paper feed roller pair 123 sends the sheet P pulled out by the pickup roller 122 into the sheet conveyance path 111.

The paper feed section 12 includes a manual paper feed section that is attached to a left side surface shown in FIG. 1 of the apparatus body 11. The manual paper feed section includes a manual feed tray 124, a pickup roller 125, and a paper feed roller pair 126. A manually fed sheet P is placed on the manual feed tray 124. When a sheet P is manually fed, as shown in FIG. 1 the manual feed tray 124 is opened from a side surface of the apparatus body 11. The pickup roller 125 pulls out a sheet P placed on the manual feed tray 124. The paper feed roller pair 126 sends the sheet P pulled out by the pickup roller 125 into the sheet conveyance path 111.

The image forming section 13, which forms a toner image that is to be transferred to the sheet P, includes a plurality of image forming units for forming toner images having different colors. In this embodiment, as these image forming units, a magenta unit 13M that uses a magenta (M) color developer, a cyan unit 13C that uses a cyan (C) color developer, a yellow unit 13Y that uses a yellow (Y) color developer, and a black unit 13Bk that uses a black (Bk) color developer are provided and arranged in sequence from upstream to downstream in the direction in which an intermediate transfer belt 141 described below is rotated (from left to right in FIG. 1). The units 13M, 13C, 13Y, and 13Bk each include a photosensitive drum 20 (image bearing member), and a charging device 21, a developing device 23, a primary transfer roller 24, and a cleaning device 25 that are arranged around the photosensitive drum 20. An exposure device 22 that is common to the units 13M, 13C, 13Y, and 13Bk is disposed below the image forming units.

The photosensitive drum 20 is driven to rotate around its axis. An electrostatic latent image is formed on the surface of the photosensitive drum 20, and then transformed into a visible image, i.e. a toner image, which is borne by the photosensitive drum 20. As an example of the photosensitive drum 20, a known non-crystalline silicon ($\alpha$-Si) photosensitive drum or organic (OPC) photosensitive drum is used. The charging device 21 uniformly charges the surface of the photosensitive drum 20 to a predetermined charge potential. The charging device 21 includes a charging roller, and a charge cleaning brush for removing toner adhering to the charging roller. The exposure device 22, which is located downstream of the charging device 21 in the direction in which the photosensitive drum 20 rotates, has various optical elements such as a light source, polygon mirror, reflecting mirror, and deflecting mirror. The exposure device 22 forms an electrostatic latent image by irradiating the surface of the photosensitive drum 20 uniformly charged at the charge potential with light modulated based on image data.

The developing device 23 is located downstream of the exposure device 22 in the direction in which the photosensitive drum 20 rotates. The developing device 23 includes a development roller 231. The development roller 231 is located at a predetermined developing nip part NP (FIG. 3), facing the photosensitive drum 20. The development roller 231 is rotated, bearing a developer containing toner and carrier on a peripheral surface thereof and supplying the toner to the photosensitive drum 20 to form a toner image.

The primary transfer roller 24, together with the photosensitive drum 20, forms a nip part with the intermediate transfer belt 141 provided in the intermediate transfer unit 14 interposed therebetween. The primary transfer roller 24 also primarily transfers the toner image on the photosensitive drum 20 onto the intermediate transfer belt 141. The cleaning device 25 cleans the peripheral surface of the photosensitive drum 20 after the transfer of the toner image.

The intermediate transfer unit 14, which is located in a space provided between the image forming section 13 and the toner replenishing section 15, includes the intermediate transfer belt 141, a drive roller 142 (not shown) rotatably supported by a unit frame (not shown), an idler roller 143, a backup roller 146, and a density sensor 100.

The intermediate transfer belt 141, which is an endless belt-shaped rotating member, is supported by the drive roller 142 and the idler rollers 143 and 146, spanning therebetween, with the peripheral surface of the intermediate transfer belt 141 in contact with the peripheral surface of each photosensitive drum 20. The intermediate transfer belt 141 is driven by the rotation of the drive roller 142 to rotate. The belt cleaning device 144 for removing toner remaining on the peripheral surface of the intermediate transfer belt 141 is located in the vicinity of the idler roller 143.

The density sensor 100 (density measuring section), which is located downstream of the units 13M, 13C, 13Y, and 13Bk, facing the intermediate transfer belt 141, measures the density of the toner image formed on the intermediate transfer belt 141. Note that in another embodiment, the density sensor 100 may measure the density of the toner image on the photosensitive drum 20 or the density of the toner image fixed to the sheet P.

A secondary transfer roller 145 is disposed outside the intermediate transfer belt 141, facing the drive roller 142. The secondary transfer roller 145 is pressed against and in contact with the peripheral surface of the intermediate transfer belt 141 to form a transfer nip part between itself and the drive roller 142. The toner image primarily transferred to the intermediate transfer belt 141 is secondarily transferred to the sheet P fed from the paper feed section 12 at the transfer nip part. In other words, the intermediate transfer unit 14 and the secondary transfer roller 145 together function as a transfer section for transferring the toner image borne on the photosensitive drum 20 to the sheet P. A roller cleaner 200 for cleaning the peripheral surface of the drive roller 142 is also provided.

The toner replenishing section 15, which is for retaining toner that is used to form an image, includes a magenta toner container 15M, a cyan toner container 15C, a yellow toner container 15Y, and a black toner container 15Bk in this embodiment. These toner containers 15M, 15C, 15Y, and 15Bk are for retaining replenishing toner of M, C, Y, and Bk, respectively. The developing devices 23 of the image forming units 13M, 13C, 13Y, and 13Bk are replenished with toner of M, C, Y, and Bk, respectively, from toner discharge openings 15H formed in the bottom surfaces of the respective containers.

The fusing section 16 includes a heating roller 161 having a heat source inside thereof, a fusing roller 162 facing the heating roller 161, a fusing belt 163 supported by the fusing roller 162 and the heating roller 161 with tension exerted on the fusing belt 163, and a pressure roller 164 facing the fusing roller 162 with the fusing belt 163 interposed therebetween, the pressure roller 164 and the fusing roller 162 together forming a fusing nip part. The sheet P fed to the fusing section 16 is heated and pressed when being passed through the fusing nip part. As a result, the toner image transferred to the sheet P is fixed to the sheet P at the transfer nip part.

The exit section 17 is formed by a top portion of the apparatus body 11 being recessed. An exit tray 171 for receiving the ejected sheet P is formed at the bottom of the recessed portion. The sheet P that was subjected to the fusing process is ejected from an upper portion of the fusing section 16 through the sheet conveyance path 111 toward the exit tray 171.

(Developing Device)

Figure 2:
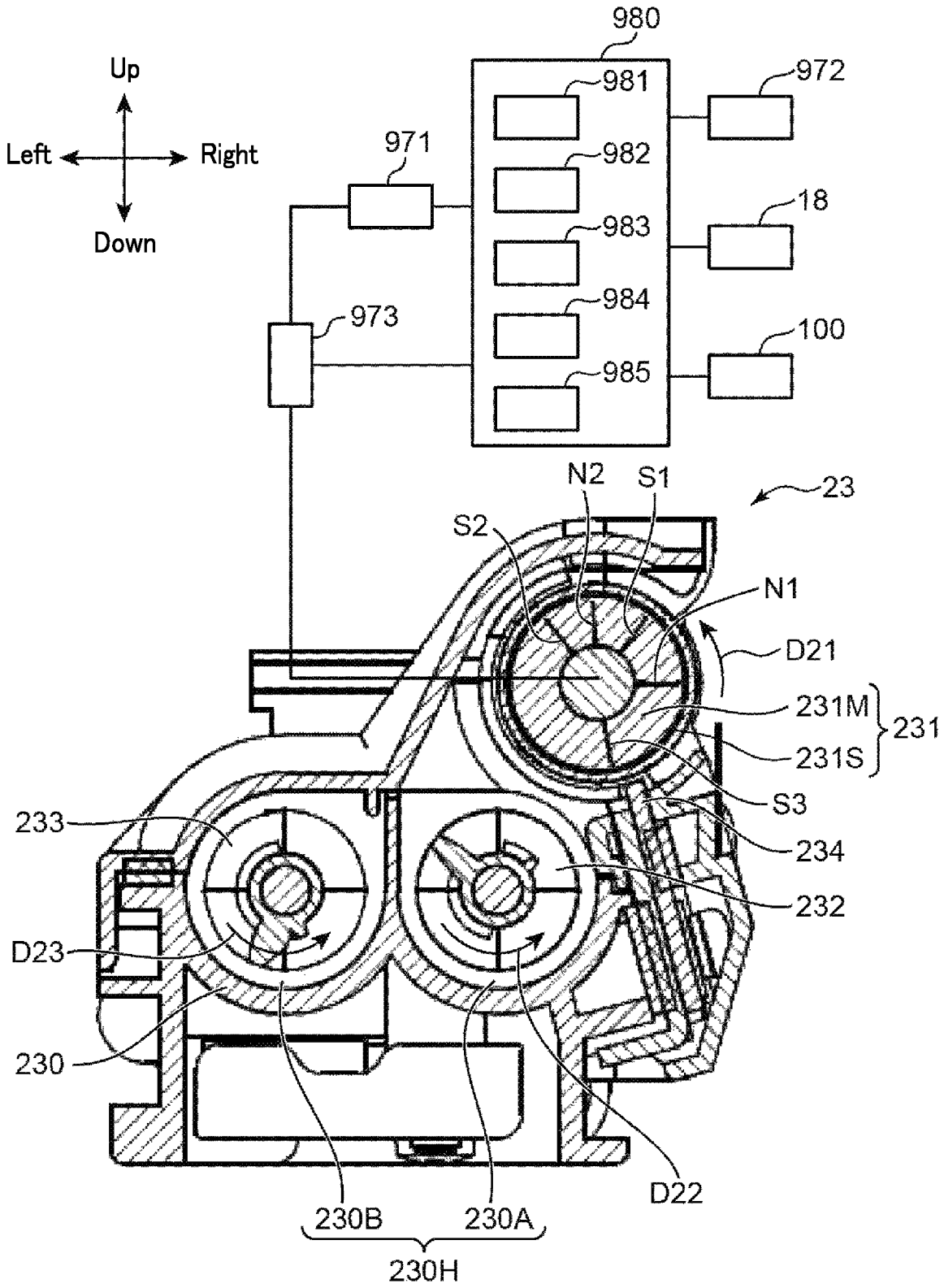
FIG. 2 is diagram including a cross-sectional view of a developing device and a block diagram of an electrical configuration of a control section.

FIG. 2 shows a cross-sectional view of the developing device 23 and a block diagram of an electrical configuration of a control section 980. The developing device 23 includes a development housing 230, the development roller 231, a first screw feeder 232, a second screw feeder 233, and a regulating blade 234. The two-component development technique is applied to the developing device 23.

The development housing 230 includes a developer containing section 230H. The developer containing section 230H contains a two-component developer containing toner and carrier. The developer containing section 230H includes a first conveyance section 230A in which the developer is conveyed in a first conveyance direction from one end to the other end in the axial direction of the development roller 231 (a direction perpendicular to the drawing paper of FIG. 2, i.e., a direction from back to front), and a second conveyance section 230B that is in communication with the first conveyance section 230A at both ends in the axial direction thereof, and in which the developer is conveyed in a second conveyance direction opposite to the first conveyance direction. The first screw feeder 232 and the second screw feeder 233 are rotated in directions indicated by arrows D22 and D23 of FIG. 2 to convey the developer in the first and second conveyance directions, respectively. In particular, the first screw feeder 232 supplies the developer to the development roller 231 while conveying the developer in the first conveyance direction. The toner contained in the developer rubs against the carrier and is thereby charged while being circulated and conveyed in the first and second conveyance directions. Meanwhile, the carrier contained in the developer is likely to be cut or stained due to rubbing against the toner while being circulated and conveyed in the first and second conveyance directions.

The development roller 231 is located at the developing nip part NP (FIG. 3), facing the photosensitive drum 20. The development roller 231 includes a sleeve 231S that is rotated, and a magnet 231M fixed inside the sleeve 231S. The magnet 231M has S1, N1, S2, N2, and S3 poles. The N1 pole functions as a main pole, the S1 and N2 poles function as a conveyance pole, and the S2 pole functions as a release pole. The S3 pole functions as a scooping pole and a regulating pole. As an example, the magnetic flux densities of the S1, N1, S2, N2, and S3 poles are set to 54 mT, 96 mT, 35 mT, 44 mT, and 45 mT, respectively. The sleeve 231S of the development roller 231 is rotated in a direction indicated by arrow D21 of FIG. 2. The development roller 231 is rotated, receiving the developer in the development housing 230, bearing a developer layer, and supplying the toner to the photosensitive drum 20. Note that in this embodiment, the development roller 231 rotates in the same direction (width direction) in which the photosensitive drum 20 rotates, at a position where the development roller 231 faces the photosensitive drum 20.

The regulating blade 234 (thickness regulating member), which is spaced apart from the development roller 231 by a predetermined distance, regulates the thickness of a layer of the developer supplied from the first screw feeder 232 to the peripheral surface of the development roller 231.

In addition to the developing device 23, the image forming apparatus 10 includes a development bias applying section 971, a drive section 972, a current measuring section 973, and a control section 980. The control section 980 includes a central processing unit (CPU), a read only memory (ROM) storing a control program, a random access memory (RAM) used as a work area for the CPU, etc.

The development bias applying section 971, which includes a direct-current power supply and an alternating-current power supply, applies a development bias that is a combination of a direct-current voltage and an alternating-current voltage, to the development roller 231, according to a control signal from a bias control section 982 described below.

The drive section 972, which includes a motor and a gear mechanism for transmitting the torque of the motor, drives the photosensitive drum 20, and in addition, the development roller 231, the first screw feeder 232, and the second screw feeder 233 in the developing device 23, to rotate during a development operation according to a control signal from a drive control section 981 described below. Note that the drive section 972 further generates a drive force for driving (rotating) other members in the image forming apparatus 10.

The current measuring section 973, which includes an ammeter, measures the current value of a current (hereinafter referred to as a "development current") that flows between the photosensitive drum 20 and the development roller 231 when the development bias applying section 971 is applying a development bias to the development roller 231. The current value measured by the current measuring section 973 is referred to by the control section 980.

The CPU executes the control program stored in the ROM to allow the control section 980 to function as a drive control section 981, a bias control section 982, a storage section 983, and a mode control section 984 (amount-of-electrostatic charge acquiring section).

The drive control section 981 controls the drive section 972 to drive the development roller 231, the first screw feeder 232, and the second screw feeder 233 to rotate. The drive control section 981 also controls a drive mechanism (not shown) to drive the photosensitive drum 20 to rotate.

The bias control section 982 controls the development bias applying section 971 during a development operation in which toner is supplied from the development roller 231 to the photosensitive drum 20, to provide potential differences between the direct and alternating-current voltages of the photosensitive drum 20 and the development roller 231. The potential differences cause toner to move from the development roller 231 to the photosensitive drum 20.

The storage section 983 stores various pieces of information that are referred to by the drive control section 981, the bias control section 982, and the mode control section 984. For example, the storage section 983 stores the number of revolutions of the development roller 231, the value of the development bias adjusted based on the environment, etc. The storage section 983 also stores various pieces of information that are referred to by the mode control section 984.

The mode control section 984 executes an amount-of-electrostatic charge measurement mode. Specifically, the mode control section 984 executes, in the amount-of-electrostatic charge measurement mode, a reference toner image developing operation, a reference straight line generating operation, and an amount-of-electrostatic charge acquiring operation.

Specifically, in the reference toner image developing operation, the mode control section 984 controls the exposure device 22 and the development bias applying section 971 to form a plurality of reference toner images having different densities on the photosensitive drum 20, where the frequency of the alternating-current voltage of the development bias is varied with the potential difference between the direct-current voltages of the development roller 231 and the photosensitive drum 20 maintained constant.

In the reference straight line generating operation, the mode control section 984 generates a reference straight line indicating a relationship between the amount of toner of each reference toner image obtained by converting the density of the reference toner image measured by the density sensor 100 into weight, and a representative value of the current values of the development current measured by the current measuring section 973 during formation of the reference toner image.

In the amount-of-electrostatic charge acquiring operation, the mode control section 984 acquires the amount of electrostatic charge of toner using the reference straight line.

(Two-Component Development)

Figure 3:
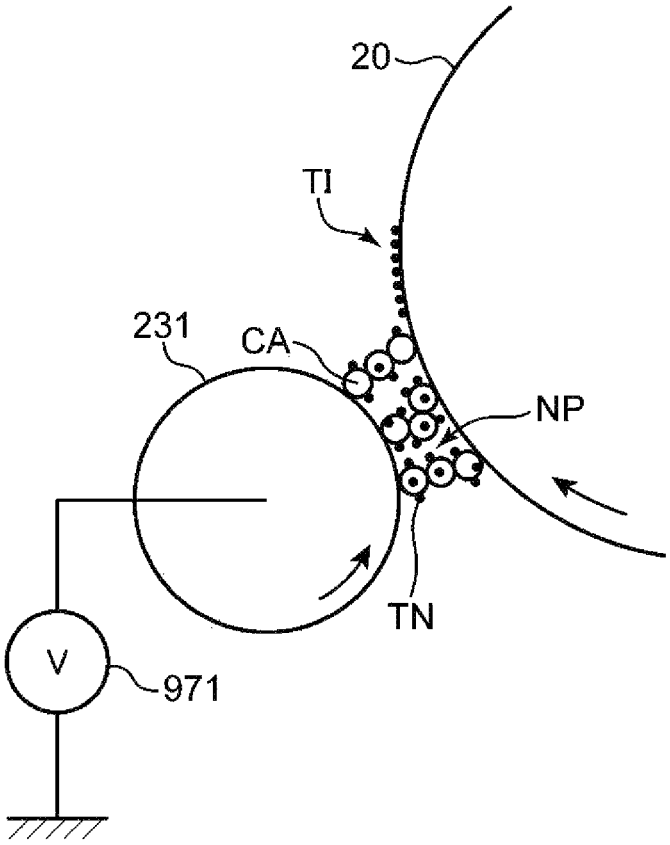
FIG. 3 is a schematic diagram of a development operation of an image forming apparatus.
Figure 4:
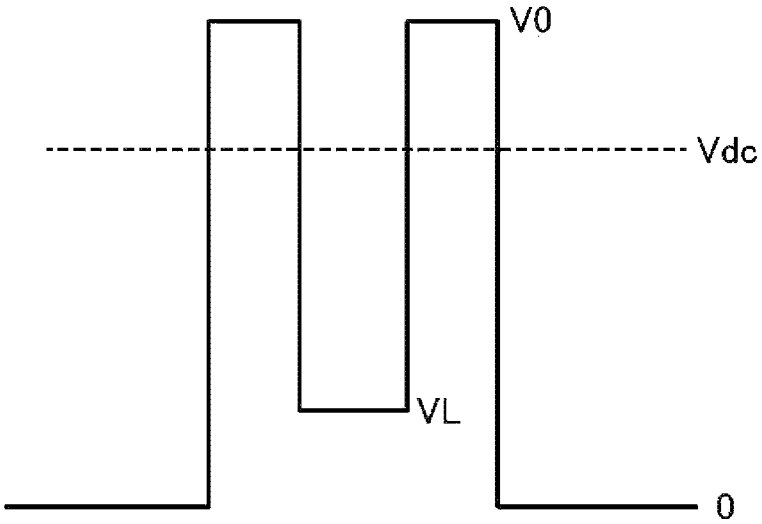
FIG. 4 is a schematic diagram showing a relationship between the magnitudes of the potentials of a photosensitive drum and a development roller.

Two-component development will be described. FIG. 3 is a schematic diagram of a development operation of the image forming apparatus 10. FIG. 4 is a schematic diagram showing a relationship between the magnitudes of the potentials of the photosensitive drum 20 and the development roller 231.

As shown in FIG. 3, the developing nip part NP is formed between the development roller 231 and the photosensitive drum 20. Toner TN and carrier CA borne on the development roller 231 form a magnetic brush. At the developing nip part NP, the toner TN is supplied from the magnetic brush to the photosensitive drum 20 to form a toner image TI.

As shown in FIG. 4, the surface potential of the photosensitive drum 20 is charged by the charging device 21 to a background region potential V0 (V). Thereafter, when the exposure device 22 emits exposure light, the surface potential of the photosensitive drum 20 is changed from the background region potential V0 to up to an image region potential VL (V), depending on an image to be printed. Meanwhile, a direct-current voltage Vdc of the development bias is applied to the development roller 231, and the direct-current voltage Vdc is combined with an alternating-current voltage (not shown).

In this case, the potential difference between the surface potential V0 and the direct-current component Vdc of the development bias inhibits or reduces toner fog that occurs in the background region where an electrostatic latent image is not formed on the surface of the photosensitive drum 20. Meanwhile, the potential difference between the surface potential VL after exposure and the direct-current component Vdc of the development bias serves as a development potential difference that causes positively-charged toner to move to an electrostatic latent image formed on the surface of the photosensitive drum 20. Furthermore, the alternating-current voltage applied to the development roller 231 accelerates the movement of the toner from the development roller 231 to the photosensitive drum 20.

Each type of toner is charged by being rubbed against the carrier during circulation and conveyance in the development housing 230. The amount of electrostatic charge on each type of toner has an influence on the amount of toner that moves to the photosensitive drum 20 due to the development bias. Therefore, if the amount of electrostatic charge of toner can be predicted with high precision in the image forming apparatus 10, the development bias and the toner density can be adjusted, depending on the number of printed copies, environmental variations, the printing mode, the page coverage, etc., to maintain good image quality. Therefore, some techniques for accurately predicting the amount of electrostatic charge of toner have conventionally been proposed, such as Patent Literature 1.

(Problems with Conventional Techniques)

It is assumed that the above proposed technique is applied to the image forming apparatus 10. In that case, a single toner image is formed on the photosensitive drum 20, and the current value of a development current flowing between the photosensitive drum 20 and the development roller 231 during the formation of the single toner image, that is measured by the current measuring section 973, is assumed to be the amount of electric charge of toner moved from the development roller 231 to the photosensitive drum 20.

In addition, the density sensor 100 measures the density of the single toner image formed on the photosensitive drum 20. Thereafter, the measured density is converted into weight, i.e. the amount of toner of the single toner image is calculated. Based on the calculated toner amount and the assumed toner electric charge, the amount of electrostatic charge of toner contained in the single toner image is calculated.

Thus, in the above proposed technique, the density of a single toner image and the current value of a development current during formation of the single toner image are measured once for each, and the amount of electrostatic charge of toner is calculated from the results of the measurements. Therefore, an error in each measurement directly affects the calculation of the amount of electrostatic charge of toner. Thus, it is unlikely to calculate the amount of electrostatic charge of toner with high precision.

(Method for Acquiring Accurate Amount of Electrostatic Charge of Toner)

With the above circumstances in mind, the present discloser has extensively studied to address the problem that an error in each measurement directly affects the calculation of the amount of electrostatic charge of toner, by identifying a relationship between the toner amount of a single toner image and the current value of a development current during formation of the single toner image, from the results of measurement of the densities of a plurality of toner images and the current values of the development current during formation of the plurality of toner images, and acquiring the amount of electrostatic charge of toner using that relationship.

Specifically, the present discloser initially formed a plurality of identical electrostatic latent images (hereinafter referred to as "reference latent images") on the photosensitive drum 20 in order to form a plurality of toner images (hereinafter referred to as "reference toner images") that were to be referred to for acquiring the amount of electrostatic charge of toner, and then transformed the reference latent images into visible images (development), where the direct-current component (hereinafter referred to as a "development DC bias") of the development bias voltage was varied. Here, the plurality of identical electrostatic latent images refer to a plurality of electrostatic latent images having the same surface potential VL after exposure, that were formed by irradiating, with the same amount of exposure light using the exposure device 22, the surface of the photosensitive drum 20 that had been charged to the background region potential V0 (FIG. 4) by the charging device 21. As a result, the present discloser found that a plurality of reference toner images having different densities are formed by developing reference latent images using different development DC biases.

Furthermore, the present discloser measured the density of each reference toner image and the current value of a development current during formation of the reference toner image, and studied a relationship between the measured densities and the measured current values.

Figure 5:
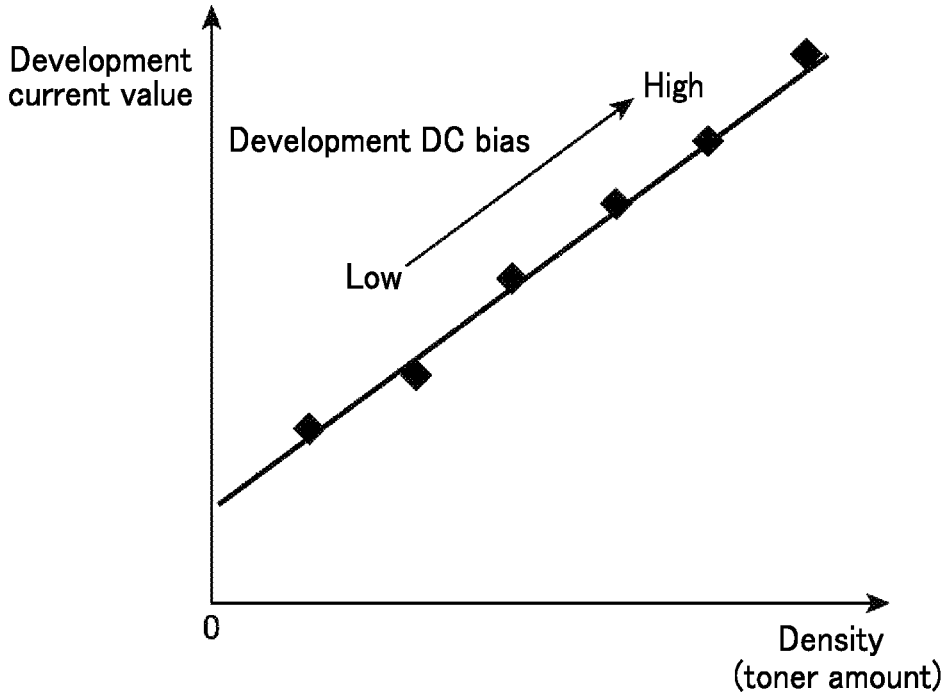
FIG. 5 is a diagram showing an example relationship between the densities or toner amounts of a plurality of reference toner images formed using different development DC biases, and current values of a development current during formation of the plurality of reference toner images.

FIG. 5 is a diagram showing an example relationship between the densities or toner amounts of a plurality of reference toner images formed using different development DC biases, and the current values of the development current during the formation of the plurality of reference toner images. As a result, the present discloser found that as shown in FIG. 5, as the development DC bias increases, the density of the reference toner image and the current value of the development current during formation of the reference toner image both increase, and as the density of the reference toner image increases, the current value of the development current during formation of the reference toner image linearly increases. The present discloser also found that the amount of toner obtained by converting the density of the reference toner image into weight using a known function, and the current value of the development current during formation of the reference toner image, have a relationship similar to the relationship between the density of the reference toner image and the current value of the development current during formation of the reference toner image.

The present discloser also found that a development current that flows between an image region where an electrostatic latent image is formed on the photosensitive drum 20, and the development roller 231, and a development current that flows between a background region where an electrostatic latent image is not present on the photosensitive drum 20, and the development roller 231, have different flowing current components.

Specifically, the present discloser found that while the development current flowing between the image region and the development roller 231 includes two current components, i.e. a current flowing due to movement of toner and a current flowing in carrier, the development current flowing between the background region and the development roller 231 includes only a current component flowing in carrier because movement of toner does not occur in the background region.

Figure 6:
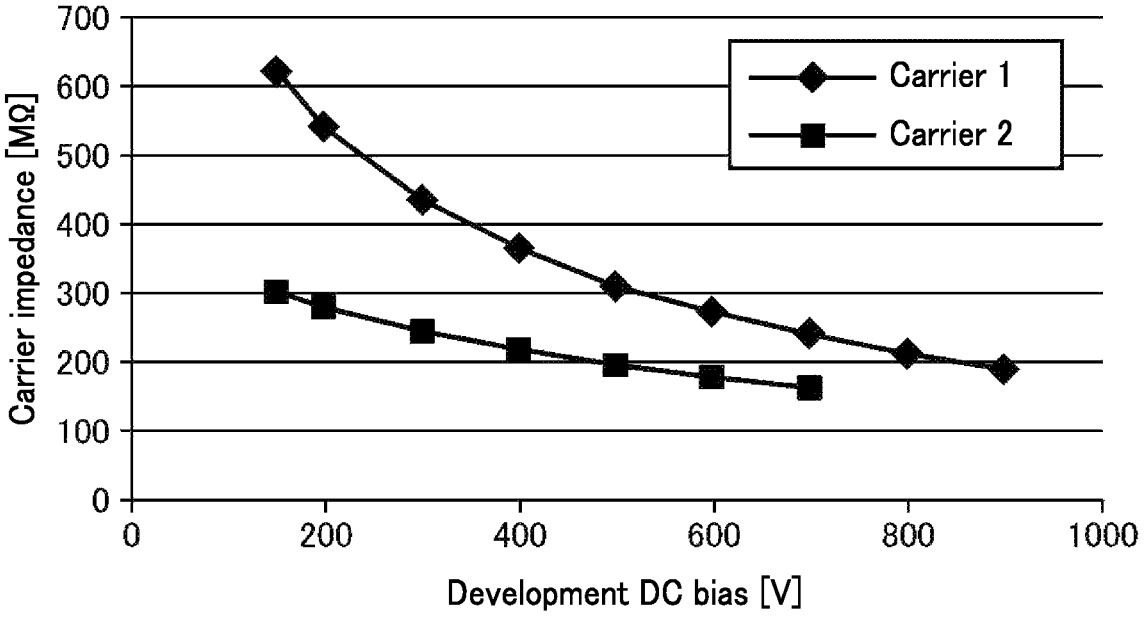
FIG. 6 is a diagram showing an example relationship between development biases and the resistance values of carrier.

FIG. 6 is a diagram showing an example relationship between the development bias and the resistance value of carrier. The present discloser studied electrical characteristics of carrier. As a result, the present discloser found that carrier has characteristics that as shown in FIG. 6, as the development DC bias increases, the impedance (resistance value) of carrier non-linearly decreases.

Figure 7:
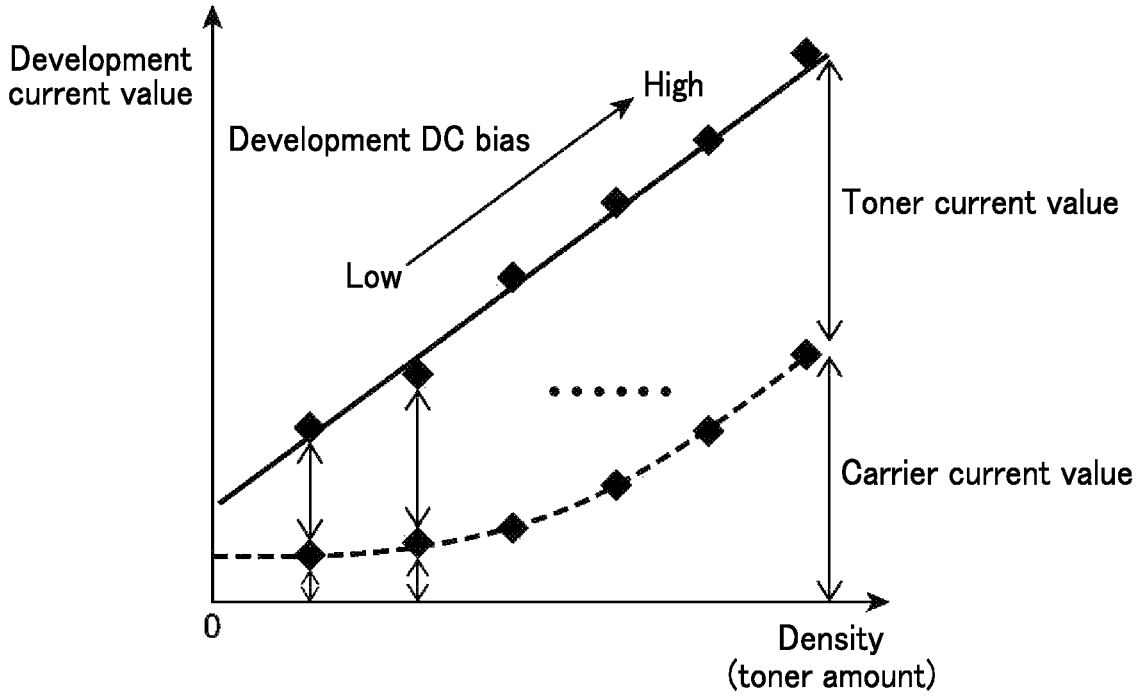
FIG. 7 is a diagram showing an example relationship between the densities or toner amounts of a plurality of reference toner images formed using different development DC biases, and toner current values and carrier current values included in the current values of a development current during formation of the plurality of reference toner images.

FIG. 7 is a diagram showing an example relationship between the densities or toner amounts of a plurality of reference toner images formed using different development DC biases, and toner current values and carrier current values included in the current values of the development current during the formation of the plurality of reference toner images. Based on the above finding, the present discloser found that the current value of the development current measured during formation of the reference toner image shown in FIG. 5 includes, as shown in FIG. 7, the current value of a current flowing in carrier (hereinafter referred to as a "carrier current value") that non-linearly increases as the development DC bias increases, and the current value of a current caused by movement of toner (hereinafter referred to as a "toner current value").

As a result, the present discloser found that when a plurality of reference toner images having different densities are formed using different development DC biases, the current value of a development current during formation of each reference toner image includes a carrier current value that non-linearly increases as the development DC bias increases, and therefore, the current value of the development current cannot be assumed to indicate the amount of electric charge of toner with high precision.

Taking the above finding into consideration, the present discloser transformed a plurality of identical reference latent images similar to those described above, into visible images (development), where the frequency of the alternating-current voltage of the development bias is varied, instead of varying the development DC bias. As a result, the present discloser found that even when a plurality of identical reference latent images are developed using respective development biases having alternating-current voltages having different frequencies, a plurality of reference toner images having different densities are formed.

Figure 8:
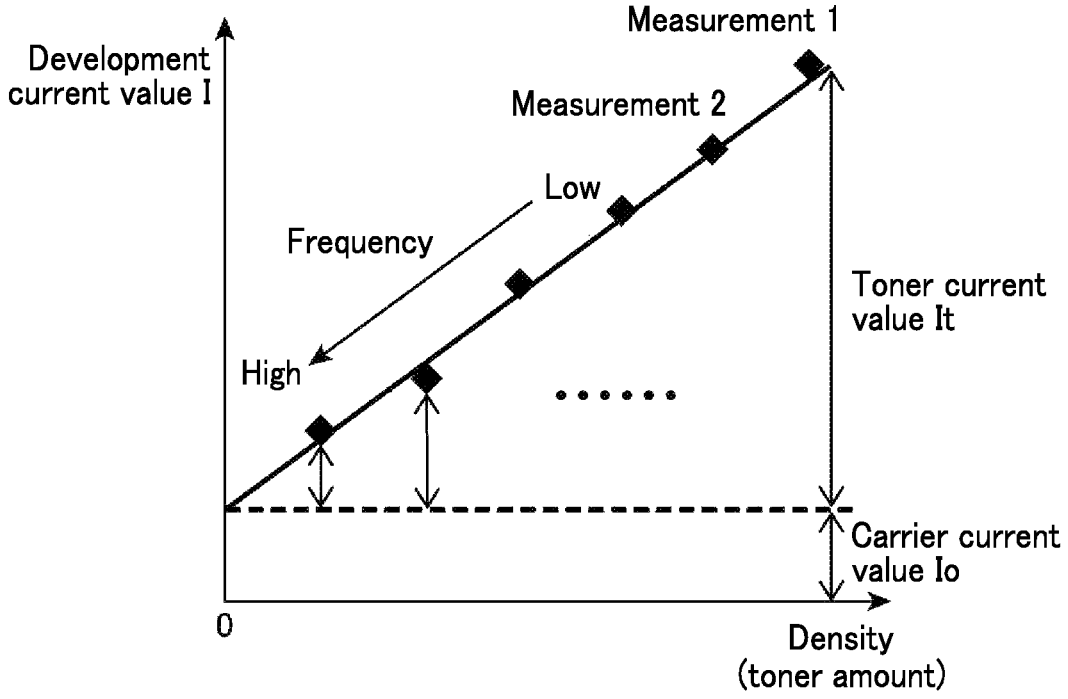
FIG. 8 is a diagram showing an example relationship between the densities or toner amounts of a plurality of reference toner images formed using respective development biases having alternating-current voltages having different frequencies, and toner current values and carrier current values included in the current values of a development current during formation of the plurality of reference toner images.

FIG. 8 is a diagram showing an example relationship between the densities or toner amounts of a plurality of reference toner images formed using respective development biases having alternating-current voltages having different frequencies, and toner current values and carrier current values included in the current values of the development current during formation of the plurality of reference toner images. Specifically, the present discloser found that as shown in FIG. 8, as the frequency increases, the density of the reference toner image and the current value of the development current during formation of the reference toner image both decrease, and in addition, as the density of the reference toner image decreases, the current value of the development current during formation of the reference toner image linearly decreases. The present discloser also found that the amount of toner obtained by converting the density of the reference toner image into weight using a known function, and the current value of the development current during formation of the reference toner image, have a relationship similar to the relationship between the density of the reference toner image and the current value of the development current during formation of the reference toner image.

In addition, the present discloser studied electrical characteristics of carrier to find that carrier has characteristics that the impedance thereof is not changed even when the frequency of the alternating-current voltage of the development bias is changed. Based on this finding, the present discloser found that when a plurality of identical reference latent images are developed using respective development biases having alternating-current voltages having different frequencies, as shown in FIG. 8 the current value I of the development current includes a constant carrier current value Ic that does not vary depending on the frequency of the alternating-current voltage of the development bias, and a toner current value It that linearly increases as the density (or toner amount) of the reference toner image increases.

As a result, the present discloser found that when a plurality of identical reference latent images are developed using respective development biases having alternating-current voltages having different frequencies, the carrier current value Ic is constant even if the density (or toner amount) of the reference toner image is changed, and the amount of a change in the current value I of the development current with respect to the amount of a change in the density (or toner amount) of the reference toner image, is the same as the amount of a change in the toner current value It with respect to the amount of a change in the density (or toner amount) of the reference toner image.

As a result, the present discloser found that even though the toner current value It and the carrier current value Ic cannot be measured separately, when a plurality of toner images are formed by varying the frequency of the alternating-current voltage of the development bias, the toner images can have different densities (or toner amounts) with the carrier current value Ic during formation of the toner images maintained constant.

Based on the above finding, the present discloser found that the toner amount of a toner image for measurement that is used to measure the amount of electrostatic charge of toner can be acquired with high precision, by forming a plurality of reference toner images having different densities using respective development biases having alternating-current voltages having different frequencies, generating a reference straight line indicating a relationship between the toner amounts of the reference toner images and the current values I of the development current during formation of the reference toner images, measuring the current value I of a development current during formation (development) of the toner image for measurement, using a development bias that is used in actual printing (image formation), and acquiring a toner amount associated with the measured current value I on the reference straight line.

As a result, the present discloser found that the amount of electrostatic charge of toner contained in the toner image for measurement can be calculated with high precision using the toner amount of the toner image for measurement acquired with high precision and the integral value of the current value of a development current measured during formation of the toner image for measurement. As used herein, the integral value of the current value of a development current measured during formation of the toner image for measurement means the integral value of the current value of a development current measured during a period of time that the toner image for measurement is developed.

Note that the integral value of the current value of a development current measured during formation of the toner image for measurement is not limited to this, and may be the product of a representative value of the current values of the development current measured during a period of time that the toner image for measurement is developed, and the length of the period of time that the toner image for measurement is developed (time required to form the toner image for measurement). As used herein, the representative value of the current values of the development current measured during a period of time that the toner image for measurement is developed means the average, maximum, minimum, or the like of the current values of the development current measured during a period of time that the toner image for measurement is developed.

(Amount-of-Electrostatic Charge Measurement Mode)

Figure 9:
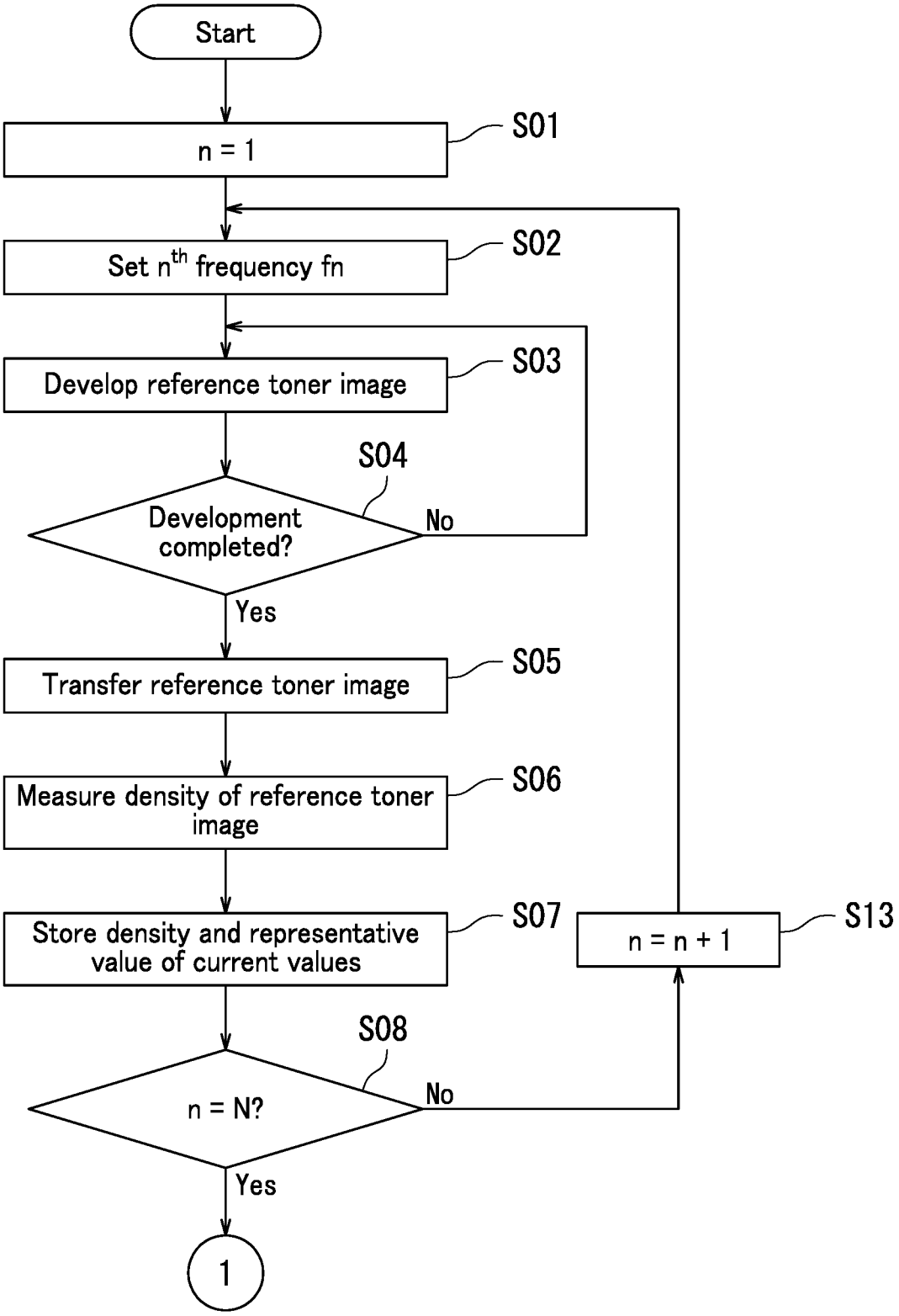
FIG. 9 is a flowchart of an amount-of-electrostatic charge measurement mode executed by a mode control section.
Figure 10:
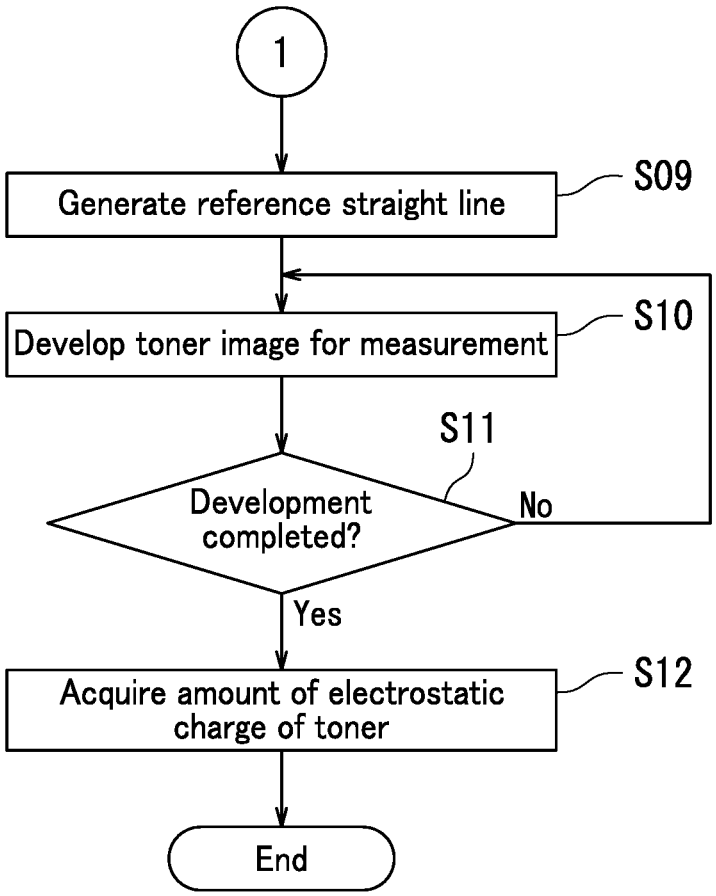
FIG. 10 is a flowchart of an amount-of-electrostatic charge measurement mode executed by a mode control section.
Figure 11:
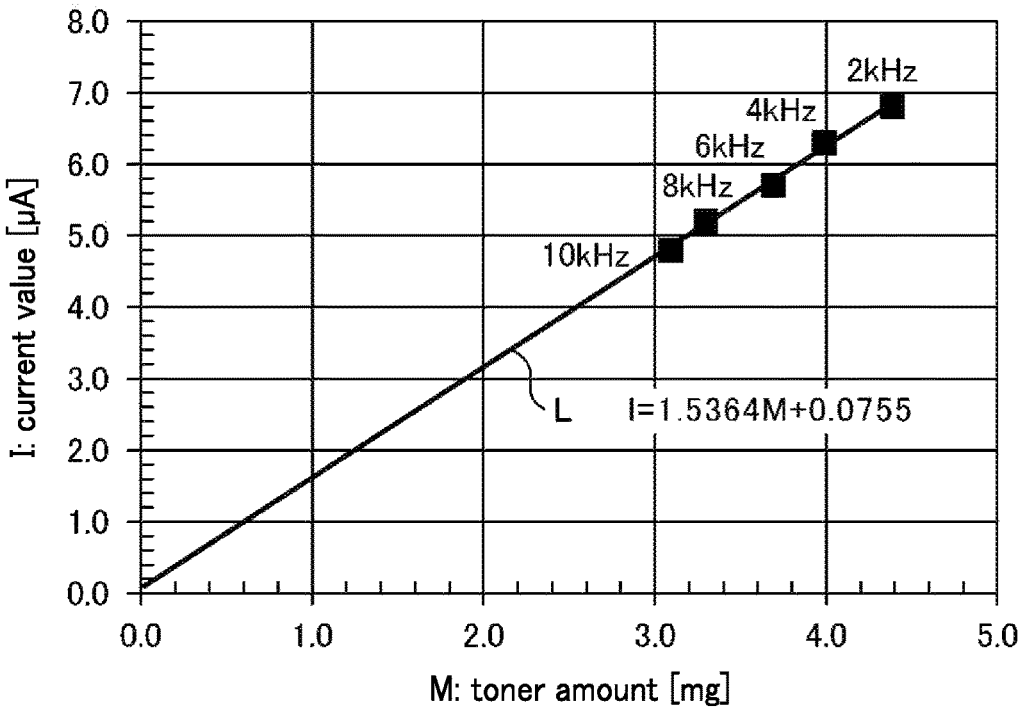
FIG. 11 is a diagram showing an example relationship between a toner amount obtained by converting the density of each reference toner image and the current value of a development current during formation of the reference toner image.

The amount-of-electrostatic charge measurement mode executed by the mode control section 984, which has been conceived by the present discloser based on the above findings, will now be described in detail. FIGS. 9 and 10 are flowcharts of the amount-of-electrostatic charge measurement mode executed by the mode control section 984. FIG. 11 is a diagram showing an example relationship between a toner amount M obtained by converting the density of each reference toner image and the current value I of a development current during formation of the reference toner image.

Figure 12:
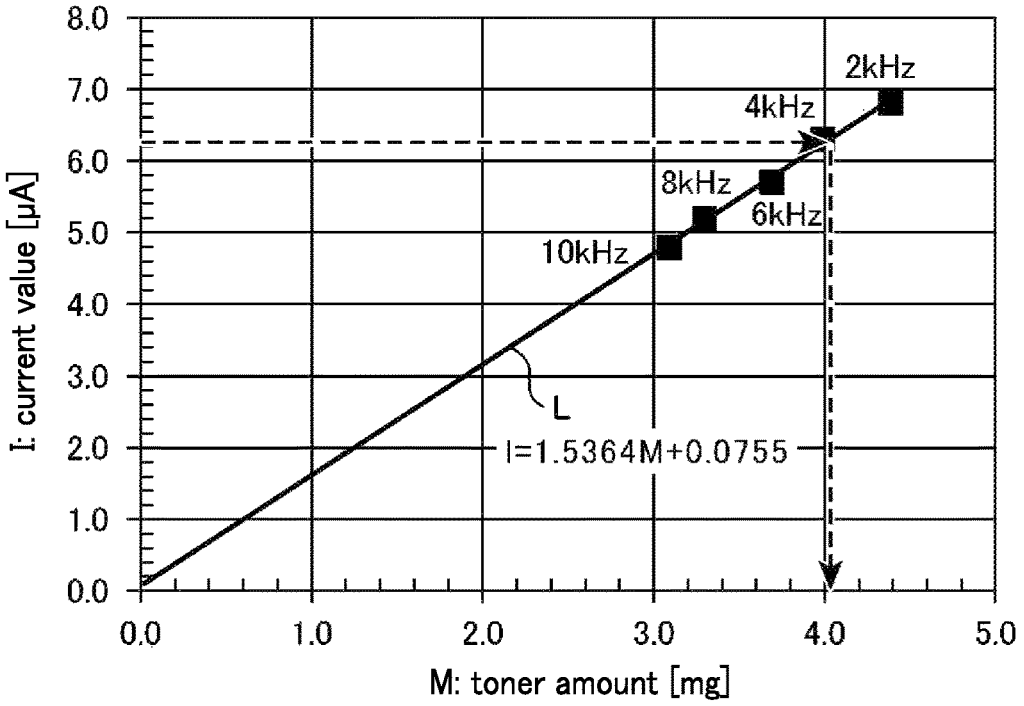
FIG. 12 is a diagram showing an example in which a toner amount is acquired from a reference straight line.

FIG. 12 is a diagram showing an example in which the toner amount M is acquired from a reference straight line L.

As shown in FIG. 9, at the start of the amount-of-electrostatic charge measurement mode, the mode control section 984 sets a variable n for changing the frequency f of the alternating-current voltage of the development bias to n=1 (step S01). Note that the mode control section 984 starts the amount-of-electrostatic charge measurement mode according to an instruction input using the operation panel 18. Alternatively, the mode control section 984 automatically starts the amount-of-electrostatic charge measurement mode at a predetermined timing, such as the activation of the image forming apparatus 10.

Thereafter, the mode control section 984 controls the drive control section 981 and the bias control section 982 to start the rotating motion of the photosensitive drum 20, and rotate the development roller 231 one or more full turns with a preset reference development bias applied thereto, and thereafter, set the frequency f of the alternating-current voltage of the development bias to an $n^{th}$ frequency fn (n=1) (step S02)

The reference development bias is set in order to prevent or reduce the influence of the history of immediately previous image formation on the amount-of-electrostatic charge measurement mode. The reference development bias is typically a predetermined development bias that is used in printing (image formation). If only a direct-current voltage is used as the reference development bias, the above history eliminating effect is weak, and therefore, a combination of a direct-current voltage and an alternating-current voltage is preferably used. Note that in step S02, the operation of rotating the development roller 231 one or more full turns with the reference development bias applied thereto is not essential, and may not be performed.

Next, the mode control section 984 causes the bias control section 982 to control the development bias applying section 971 so that the development bias in which the frequency f of the alternating-current voltage is set to the $n^{th}$ frequency fn is applied to the development roller 231 with the potential difference between the direct-current voltages of the development roller 231 and the photosensitive drum 20 maintained constant, to form (develop) a preset reference toner image on the photosensitive drum 20. The mode control section 984 also causes the current measuring section 973 to measure the current value of a development current during the formation of the reference toner image (step S03).

Specifically, in step S03, the mode control section 984 controls the exposure device 22 to form (develop) a preset reference latent image on the photosensitive drum 20. Thereafter, the mode control section 984 causes the bias control section 982 to control the development bias applying section 971 so that the development bias in which the frequency f of the alternating-current voltage is set to the $n^{th}$ frequency fn is applied to the development roller 231 with the potential difference between the direct-current voltages of the development roller 231 and the photosensitive drum 20 maintained constant. As a result, a reference toner image obtained by transforming a reference latent image into a visible image is formed on the photosensitive drum 20.

Thereafter, when the development of the reference toner image is completed (Yes in step S04), and the reference toner image is transferred from the photosensitive drum 20 to the intermediate transfer belt 141 (step S05), the mode control section 984 causes the density sensor 100 to measure the density of the reference toner image (step S06).

Thereafter, the mode control section 984 stores, into the storage section 983, the density of the reference toner image measured in step S06 and a representative value of the current values of the development current measured during development of the reference toner image, in association with the $n^{th}$ frequency fn (step S07). As used herein, the representative value of the current values of the development current means the average, maximum, minimum, or the like of the current values of the development current measured during formation of the reference toner image.

Next, the mode control section 984 determines whether or not the variable n related to the frequency is equal to a preset reference number of times N (step S08). When the variable n is not equal to the reference number of times N (No in step S08), the number of n is incremented by one (n=n+1, step S13), and steps S02 to S07 are repeated. Note that in order to increase the precision of the measurement, the reference number of times N is preferably set to two or more, more preferably three or more. Note that in this embodiment, the reference number of times N is set to five.

Meanwhile, when the variable n is equal to the reference number of times N (Yes in step S08), as shown in FIG. 11 the mode control section 984 generates a reference straight line indicating a relationship between the toner amount of each reference toner image and a representative value of the current values of the development current during development of the reference toner image, based on the densities of N reference toner images stored in associated with N frequencies f in the storage section 983, and representative values of the current values of the development current measured during development of the N reference toner images (step S09).

Specifically, in step S09, as shown in FIG. 10, the mode control section 984 plots N points indicating the toner amounts M (e.g., 4.5 mg) obtained by converting, into weight, the densities of the N reference toner images stored in associated with the N frequencies f (e.g., 2 kHz) in the storage section 983, and the representative values (e.g., 6.9 μA) of the current values I of the development current stored in association with the frequencies f in the storage section 983, in a two-dimensional coordinate system in which the horizontal axis represents the toner amounts M of the reference toner images, and the vertical axis represents the current values I of the development current. Thereafter, the mode control section 984 generates, as the reference straight line L, an approximate straight line (e.g., I=1.5364M+0.0755) passing in the vicinity of the N points.

Next, the mode control section 984 causes the bias control section 982 to control the development bias applying section 971 as in step S03, and thereby to apply a predetermined development bias that is used in printing (image formation) to the development roller 231, so that a preset toner image for measurement is formed (developed). The mode control section 984 also causes the current measuring section 973 to measure the current value I of a development current during the formation of the toner image for measurement (step S11).

Thereafter, when the development of the toner image for measurement is completed (Yes in step S11), the mode control section 984 acquires the amount of electrostatic charge of toner contained in the toner image for measurement, using the reference straight line L generated in step S09 and the current value I of the development current during the formation of the toner image for measurement, that is measured in step S11 (step S12).

Specifically, in step S12, as shown in FIG. 11, the mode control section 984 acquires a toner amount M (e.g., 4.0 mg) associated with the same representative value as the representative value (e.g., 6.2 μA) of the current value I of the development current measured in step S11, on the reference straight line L generated in step S09, as the toner amount M of the toner image for measurement.

Thereafter, the mode control section 984 assumes that the integral value of the current value I of the development current measured in step S11 is the amount of electric charge of toner of the toner image for measurement. As used herein, the integral value of the current value I of the development current measured in step S11 means the integral value of the current value I of the development current measured by the current measuring section 973 during a period of time that the toner image for measurement is developed in step S11. Note that the integral value of the current value I of the development current measured in step S11 is not limited to this, and may be the product of the representative value (average, maximum, or minimum, etc.) of the current values I of the development current measured in step S11 and the period of time that the toner image for measurement is developed (time required to form the toner image for measurement).

Thereafter, the mode control section 984 acquires a result obtained by dividing the assumed amount of electric charge of toner by the acquired toner amount M (e.g., 4.0 mg) of the toner image for measurement (=the amount of electric charge of toner/the toner amount M) as the amount of electrostatic charge of toner contained in the toner image for measurement.

Thus, in the amount-of-electrostatic charge measurement mode, a plurality of reference toner images having different densities are formed using respective development biases having alternating-current voltages having different frequencies f, with the potential difference between the direct-current voltages of the development roller 231 and the photosensitive drum 20 maintained constant. Thereafter, from the results of the density of the reference toner image and the current value I of the development current during formation of the reference toner image, that are each measured the reference number of times N, the reference straight line L is generated that indicates a relationship between the toner amount M of the reference toner image and the representative value of the current values I of the development current during formation of the reference toner image.

Thereafter, the toner amount M of the toner image for measurement is acquired from the relationship between the toner amount M of the reference toner image and the representative value of the current values I of the development current during formation of the reference toner image, that is indicated by the generated reference straight line L. Therefore, compared to when, as in the conventional case, the density of the toner image for measurement is measured once, and the toner amount M of the toner image for measurement is obtained by converting the measured density, the problem that an error in the measurement of the density of the toner image for measurement directly affects the calculation of the toner amount M of the toner image for measurement can be eliminated or reduced.

As a result, the toner amount M used to acquire the amount of electrostatic charge of toner can be acquired with higher precision than in the conventional art. As a result, by using the toner amount M acquired with higher precision than in the conventional art and the integral value of the current value I of the development current during formation of the toner image for measurement, the amount of electrostatic charge of toner can be acquired with higher precision than in the conventional art.

Furthermore, in the amount-of-electrostatic charge measurement mode, the amount of electrostatic charge of toner is acquired using N reference toner images having different densities, that are obtained by transforming N identical reference latent images formed on the photosensitive drum 20 by performing step S03 N times, into visible images using respective development biases having alternating-current voltages having different frequencies fn.

Therefore, in the case where the amount of electrostatic charge of toner is acquired using a plurality of reference toner images obtained by transforming a plurality of different reference latent images formed on the photosensitive drum 20 into visible images using respective development biases having alternating-current voltages having different frequencies f, the influence of the difference between electrostatic latent images on the amount of electrostatic charge of toner can be eliminated or reduced, and therefore, the amount of electrostatic charge of toner can be obtained with high precision.

Variations

Although a few embodiments of the present disclosure have been shown and described, the present disclosure is not limited to these embodiments, and may be embodied in the following variations.

(1) The development roller 231 may, for example, have a knurled, dimpled, or blasted surface.

(2) Assuming that the representative value (e.g., 0.0755 in FIGS. 11 and 12) of the current values I of the development current that is associated with the toner amount M of zero on the reference straight line L indicates the carrier current value Ic (FIG. 8), the mode control section 984 may assume, in step S12, a result obtained by subtracting the product of the representative value (e.g., 0.0755) of the current values I of the development current that is associated with the toner amount M of zero on the reference straight line L and the time required to develop (form) the toner image for measurement in step S11, from the integral value of the current value I of the development current measured in step S11, as the amount of electric charge of toner contained in the toner image for measurement.

In this case, in the amount-of-electrostatic charge measurement mode, based on the above findings of the present discloser, the integral value of the current value Ic of a current flowing in carrier during formation of the toner image for measurement, that indicates the product of the representative value of the current values I of the development current that is associated with the toner amount M of zero on the reference straight line L and the time required to form the toner image for measurement, is removed from the integral value of the current value I of the development current measured during formation of the toner image for measurement, and therefore, only the integral value of the current value It of a current that moves toner from the development roller 231 to the photosensitive drum 20 can be assumed as the amount of electric charge of toner contained in the toner image for measurement with high precision. As a result, the amount of electric charge of toner assumed with high precision can be used to acquire the amount of electrostatic charge of toner contained in the toner image for measurement with higher precision.

(3) Steps S10 and S11 may be removed. In step S12, the mode control section 984 may acquire, as the amount of electrostatic charge of toner, the product of the slope (e.g., 1.5364 in the example of FIGS. 11 and 12) of the reference straight line L and a representative value (average, maximum, or minimum, or the like) of the time required to form the respective reference toner images in step S03.

According to this feature, the result of dividing the product of the representative value of the current values I of the development current during formation of the reference toner images and the representative value of the time required to form the respective reference toner images by the toner amount M of the reference toner image, that is indicated by the product of the slope of the reference straight line L and the representative value of the time required to form the respective reference toner images in step S03, is acquired as the amount of electrostatic charge of toner.

Therefore, according to this feature, it is assumed that the product of the representative value of the current values I of the development current during formation of the reference toner images and the representative value of time required to form the respective reference toner images is the amount of electric charge of toner moved during formation of the reference toner image, and the result of dividing the assumed amount of electric charge of toner by the toner amount M of the reference toner image (=the amount of electric charge of toner/the toner amount M) can be appropriately acquired as the amount of electrostatic charge of toner.

(4) In each occurrence of step S03, the mode control section 984 controls the exposure device 22 to irradiate the surface of the photosensitive drum 20 charged at the background region potential V0 (FIG. 4) with exposure light having a light amount different from that used in previous occurrences of step S03, so that a plurality of different reference electrostatic latent images are formed on the photosensitive drum 20. Thereafter, the mode control section 984 may transform the plurality of different reference electrostatic latent images formed on the photosensitive drum 20, into visible images using respective development biases having alternating-current voltages having different frequencies f, to form a plurality of reference toner images having different densities on the photosensitive drum 20.

(5) As shown in FIG. 1, in the case where the image forming apparatus 10 has a plurality of developing devices 23, the amount-of-electrostatic charge measurement mode according to the above embodiment may be performed in one or two developing devices 23, and the result may be used in the other developing devices 23.

What is claimed is:

1. An image forming apparatus comprising:

an image bearing member configured to rotate, having a surface on which an electrostatic latent image is formed, and configured to bear a toner image obtained by transforming the electrostatic latent image into a visible image;

an exposure device configured to form the electrostatic latent image on the surface of the image bearing member;

a development roller disposed facing the image bearing member, and configured to rotate, bear a developer containing toner and carrier on a peripheral surface thereof, and supply the toner to the image bearing member and thereby form the toner image;

a development bias applying section configured to apply a development bias including a combination of a direct-current voltage and an alternating-current voltage to the development roller;

a density measuring section configured to measure a density of the toner image;

a current measuring section configured to measure a current value of a development current flowing between the image bearing member and the development roller; and an amount-of-electrostatic charge acquiring section, wherein the amount-of-electrostatic charge acquiring section executes a reference toner image developing operation of controlling the exposure device and the development bias applying section to form a plurality of reference toner images having different densities on the image bearing member, where the frequency of the alternating-current voltage of the development bias is varied with a potential difference between direct-current voltages of the development roller and the image bearing member maintained constant, a reference straight line generating operation of generating a reference straight line indicating a relationship between a toner amount of each reference toner image obtained by converting the density of the reference toner image measured by the density measuring section into weight, and a representative value of current values of the development current measured by the current measuring section during formation of the reference toner image, and an amount-of-electrostatic charge acquiring operation of acquiring the amount of electrostatic charge of the toner using the reference straight line.

2. The image forming apparatus of claim 1, wherein in the reference toner image developing operation, the amount-of-electrostatic charge acquiring section controls the exposure device to form a plurality of identical reference latent images on the image bearing member, and controls the development bias applying section to transform the plurality of reference latent images into visible images using the respective development biases having alternating-current voltages having different frequencies, and thereby form the plurality of reference toner images.

3. The image forming apparatus of claim 1, wherein in the amount-of-electrostatic charge acquiring operation, the amount-of-electrostatic charge acquiring section acquires the product of the slope of the reference straight line, and a representative value of time required to form the respective reference toner images in the reference toner image developing operation, as the amount of electrostatic charge of the toner.

4. The image forming apparatus of claim 1, wherein in the amount-of-electrostatic charge acquiring operation, the amount-of-electrostatic charge acquiring section, when controlling the exposure device and the development bias applying section to form a toner image for measurement on the image bearing member, acquires a toner amount associated with the same representative value as the representative value of the current values of the development current measured by the current measuring section during formation of the toner image for measurement, on the reference straight line, as a toner amount of the toner image for measurement, and acquires the amount of electrostatic charge of the toner using the acquired toner amount of the toner image for measurement and an integral value of the current value of the development current measured by the current measuring section during formation of the toner image for measurement.

5. The image forming apparatus of claim 4, wherein in the amount-of-electrostatic charge acquiring operation, the amount-of-electrostatic charge acquiring section assumes a result of subtracting the product of the representative value of the current values of the development current associated with a toner amount of zero on the reference straight line and time required to form the toner image for measurement, from the integral value of the current value of the development current measured by the current measuring section during formation of the toner image for measurement, as the amount of electric charge of toner contained in the toner image for measurement, and acquires a result of dividing the assumed amount of electric charge of the toner by the acquired toner amount of the toner image for measurement, as the amount of electrostatic charge of the toner.

* * * * *